US008938996B2

(12) United States Patent
Reinholz et al.

(10) Patent No.: US 8,938,996 B2
(45) Date of Patent: Jan. 27, 2015

(54) METHOD OF, AND A DEVICE FOR, EVALUATING INFORMATION REGARDING A TREATMENT AGENT IN A WASHING MACHINE

(75) Inventors: Robby Reinholz, Berlin (DE); Ingo Schulze, Panketal (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 1047 days.

(21) Appl. No.: 12/680,251

(22) PCT Filed: Sep. 9, 2008

(86) PCT No.: PCT/EP2008/061939
§ 371 (c)(1),
(2), (4) Date: Apr. 8, 2010

(87) PCT Pub. No.: WO2009/043693
PCT Pub. Date: Apr. 9, 2009

(65) Prior Publication Data

US 2010/0300155 A1 Dec. 2, 2010

(30) Foreign Application Priority Data

Sep. 28, 2007 (DE) ..... 10 2007 046 555

(51) Int. Cl.
*D06F 13/02* (2006.01)
*D06F 39/00* (2006.01)
(Continued)

(52) U.S. Cl.
CPC ..... *D06F 39/005* (2013.01); *D06F 35/006* (2013.01); *D06F 39/02* (2013.01); *D06F 2202/10* (2013.01); *D06F 2202/12* (2013.01); *D06F 2204/02* (2013.01)
USPC ..... 68/137; 68/12.02; 68/17 R; 68/12.18; 68/12.19; 68/28; 134/18; 134/25.1; 134/56 R; 134/100.1; 134/99.2; 222/1; 222/23; 222/52; 222/71

(58) Field of Classification Search
CPC ... D06F 39/005; D06F 39/02; D06F 2202/10; D06F 2202/12; D06F 39/003
USPC ..... 68/137, 12.02, 17 R, 12.18, 12.01, 68/12.19, 12.27; 134/18, 25.1, 56 R, 100.1, 134/99.2; 222/1, 23, 52
See application file for complete search history.

(56) References Cited

U.S. PATENT DOCUMENTS

2002/0088502 A1 7/2002 Van Rompuy et al.
2008/0276969 A1 11/2008 Vanantwerp et al.

FOREIGN PATENT DOCUMENTS

DE 3303292 A1 5/1984
DE 29513262 U1 1/1996
(Continued)

OTHER PUBLICATIONS

Office Action issued Jul. 9, 2014 in corresponding Korean Application No. 10-2010-7006593 with English translation thereof.

*Primary Examiner* — Michael Barr
*Assistant Examiner* — Thomas Bucci
(74) *Attorney, Agent, or Firm* — Nixon & Vanderhye P.C.

(57) ABSTRACT

A treatment agent metering information evaluator of a washing machine includes a reader that reads portion-wise metering information from an information carrier of a storage container that is in close proximity to the reader, a controller that receives the portion-wise metering information from the reader, a meter that meters portions of treatment agent from the storage container into a treatment process of a washing treatment program, and storage that stores empirical information about experiences of the use of the treatment agent during the treatment process for subsequent application of the treatment agent. The reader includes a transmitter for transmitting the empirical information.

20 Claims, 2 Drawing Sheets

(51) Int. Cl.
*D06F 35/00* (2006.01)
*D06F 39/02* (2006.01)

(56) References Cited

FOREIGN PATENT DOCUMENTS

| | | | | | |
|---|---|---|---|---|---|
| DE | 19741023 | A1 | | 3/1999 | |
| DE | 19747150 | A1 | | 4/1999 | |
| DE | 69417146 | T2 | | 8/1999 | |
| DE | 19810222 | A1 | | 9/1999 | |
| DE | 19814447 | A1 | | 10/1999 | |
| DE | 10039408 | A1 | | 12/2001 | |
| DE | 10035837 | A1 | | 2/2002 | |
| DE | 10144667 | A1 | | 3/2003 | |
| DE | 10260144 | A1 | | 7/2004 | |
| EP | 1088927 | A1 | | 4/2001 | |
| EP | 1318225 | A1 | * | 6/2003 | ..... D06F 39/02 |
| EP | 1452636 | A2 | * | 9/2004 | ..... D06F 33/02 |
| JP | 2004-510512 | | | 4/2004 | |
| JP | 2005-211214 | | | 8/2005 | |
| JP | 2005-211214 | A | | 8/2005 | |
| JP | 2006-320472 | A | | 11/2006 | |
| WO | 0229150 | A1 | | 4/2002 | |
| WO | 2008128899 | A2 | | 10/2008 | |

* cited by examiner

METHOD OF, AND A DEVICE FOR, EVALUATING INFORMATION REGARDING A TREATMENT AGENT IN A WASHING MACHINE

BRIEF SUMMARY OF THE INVENTION

The invention relates to a method and a device for evaluating information regarding a treatment agent, which is kept for portion-wise metering purposes in a transporting or supply container which can be inserted into a washing machine, this information being contained in a machine-readable manner in an information carrier which is connected to the transporting or supply container, and the washing machine contains a reader, which extracts the information of the information carrier, in the event of the latter being in close proximity to the reader, from the information carrier and passes it on to a control device, which introduces individually measured portions of the treatment agent into the treatment process in a suitable manner and at suitable points in time of a laundry-treatment program.

DE 33 03 292 A1 discloses a method and a device for inputting data regarding liquid detergents kept in the transporting containers into an electronic control device. The transporting containers therein have data captions, in which details relating to the type and/or concentration of the detergents are contained. The content of this caption is read into the control device of the metering device by means of a reader. The known method assumes that transporting containers are provided with a part which is glued or mechanically connected to the container, in which information, which is not visible to the eye, but can instead be read using a machine and has the afore-cited content, is stored. This may be magnetically, optically or electrically readable information. Such information was originally contained in a bar code representation, but suggestions were then also made to integrate such information into mechanically encoded plug-in cards or such with regions which can be read magnetically, optically or electrically. For instance DE 100 39 408 A1 [0013], [0014]—such information can also be stored as electrically selectively readable frequency parts of a so-called RFID or transponder, which are queried by a transponder reader.

The known method, devices and measures for transmitting information relating to the detergent to be used are not suited, within the meaning of an interaction with the control device of the relevant device using the detergent, also to evaluate information relating to specifications during the use of the detergent.

The object underlying the invention is therefore to embody a method and a device of the type cited in the introduction such that the information transmitted by the treatment agent is supplemented by such information, which is obtained upon using this treatment agent and arises on account of experience with this treatment agent.

The invention achieves this object by a method, whereupon experiences obtained during the treatment process upon using the treatment agent are stored in the form of empirical information and are kept for subsequent applications of this treatment agent. A method of this type can in this way render the use of a washing machine user-friendly, such that the machine adjusts itself, in a learning manner, to the treatment agent used and automatically adjusts the treatment program to specifications of the treatment agent. As a result, interventions by a person using the washing machine, in the form of adjustments to the treatment program based on intrinsic, laboriously gained experience, are obsolete.

The empirical information can be stored in the control device of the washing machine and can be called up from there for further processing, upon recognition of the treatment agent used again; It nevertheless appears meaningful to transmit the empirical information according to an advantageous development of the inventive method for the purpose of storage on the information carrier. The recognition of a treatment agent presumed already to have been used may namely be faulty. The stored empirical information is then assigned to another treatment agent and the variation of the following treatment process relating thereto is false and results in poor treatment results. If the empirical information is however transmitted back to the information carrier and stored there in accordance with an advantageous development, it is then irrevocably and doubtlessly assigned to the relevant treatment agent.

It is further advantageous if the empirical information is transmitted as soon as an information carrier has been identified as being in close proximity to the reader having information relating to the treatment agent relevant to the empirical information. Empirical information can then be automatically assigned without any special attention on the part of an operator.

The empirical information advantageously relates to the respective metering quantities, measured reactions from the treatment process, quantity and type of laundry to be treated and the respectively selected or adjusted treatment program itself and/or its measurable parameters. The empirical information can then advantageously be available during each further treatment process when selecting or adjusting the same or at least a comparable treatment program for the metering quantities and/or time instants adjusted to the experiences of another variation of the treatment program. Processes of this type proceed automatically and without being discernible externally. They may however also be indicated on the washing machine by suitable optical and/or acoustic means.

The empirical information can be processed in a program-forming manner in accordance with one development of the inventive method. A new program combination then to some extent develops, which is also to be available for reuse with the same treatment agent. To this end, a newly formed treatment program is, as a result of empirical information, stored in a retrievable fashion as a customer-specific program. Then whenever the same treatment agent is used again, e.g. with an automatic metering, this customer-specific treatment program can first be offered for selection purposes.

Empirical information can possibly be processed in a comparative and/or program-forming fashion with the first usage of another or similar treatment agent. As a result, the two comparable treatment agents are so-to-speak arranged in the same group, which form the program from the same empirical information and/or assign the same formed program to the treatment agent.

In a device, which is to be suited to implementing the described method, the reader on the washing machine advantageously contains a transmit device for transmitting empirical information. At this point, the washing machine has to date only contained a receive device for information from the information carrier, e.g. from a transponder, which has transmitted the information using radio frequencies. In the same way, the empirical information can however also be transmitted from the washing machine back to the transponder. The necessary transmit device is to this end to be correctly arranged in close proximity to the information carrier of the properly installed transporting or supply container used in the washing machine for the treatment agent. The empirical information can then be transmitted immediately and directly to the information carrier.

To this end, the information carrier advantageously contains a receiver and a storage device for the transmitted empirical information. This empirical information can be stored in the same or a different language to the original information relating to the treatment agent. When using another language, the different categories of the information can be more easily distinguished from one another. They are then addressed in a different fashion in order to read them out in a correspondingly different fashion.

In order to take the obtained empirical information into account, the control device can contain modules, which result in information-specific variations of a selected or adjusted treatment program being identified and storage devices, which are suited to storing and preparing information-specific variations. Comparators can also be contained therein, which are able to reidentify an already previously used treatment agent and can make the assignment to the information-specific variations from the reidentification.

BRIEF DESCRIPTION OF THE DRAWINGS

On the basis of an exemplary embodiment shown in the drawing, the invention is explained in more detail as a method and as a device, in which.

DETAILED DESCRIPTION OF EXEMPLARY EMBODIMENTS OF THE PRESENT INVENTION

Figure 1:
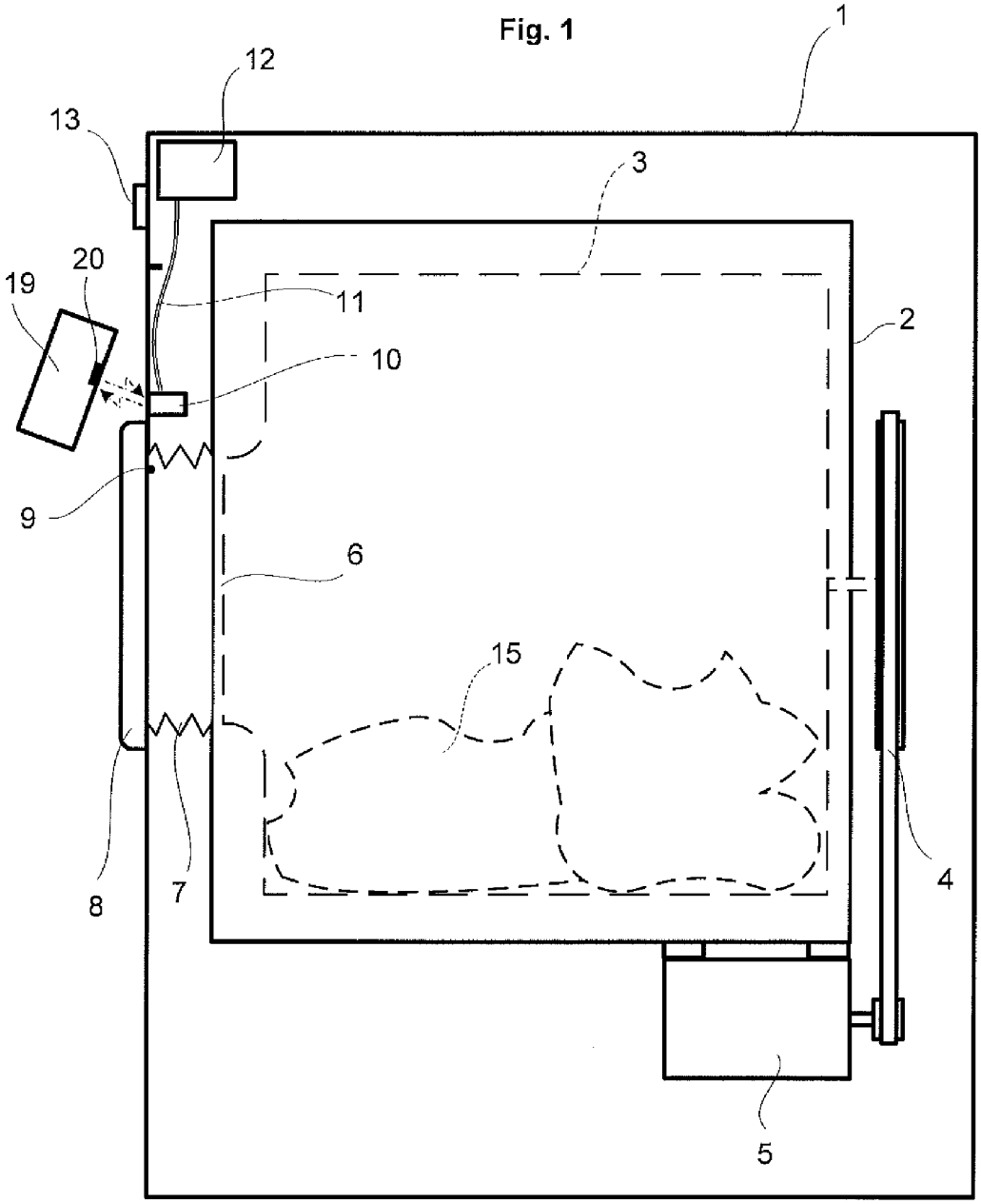
FIG. 1 shows a lateral view of a washing machine, with the essential parts inside its housing 1 being shown for the sake of easier recognizability, comprising a transporting or supply container for a treatment agent opposite to a reader.

The tub 2 of a washing machine, here a washing machine, is mounted so as to oscillate within the housing 1 in a manner (not shown in further detail). It encloses a washing drum 3, which can be driven backwards by way of a belt drive 4 by an electric motor 5 mounted suspendably below the tub 2. On the front panel, the washing drum 3 and the tub 2 have large loading openings 6 which are flush with one another and essentially the same size, which are connected by way of a rubber collar 7 to a loading opening 9 in the housing 1. The washing drum 3 can be loaded with clothing 15 through these openings and the clothing can be unloaded therefrom. The loading opening 9 can be closed with a door 8 for operation of the washing machine.

In an embodiment of a washing machine known from the prior art, a reader 10 is located above the loading opening 9, which is preferably embodied as reader identifying a transponder (RFID tags). With such a reader, laundry items provided with transponders can also be identified for instance, as described in DE 197 47 150 A1. With such a reader 10, transponders 20 can however also be read, which are added for instance to a transporting or supply container 19 for a treatment agent and contain information relating to the assigned treatment agent.

The read information can be routed via a data line 11 to a program control device 12, which is used to receive and further process entries by the customer into input devices 13 and to control the overall treatment process. In this program control device 12, the read information is also converted into recommendations for the selection and metering of the treatment agent, as a function of process parameters, and is reproduced in a readable fashion on a display 14 (FIG. 2).

Figure 2:
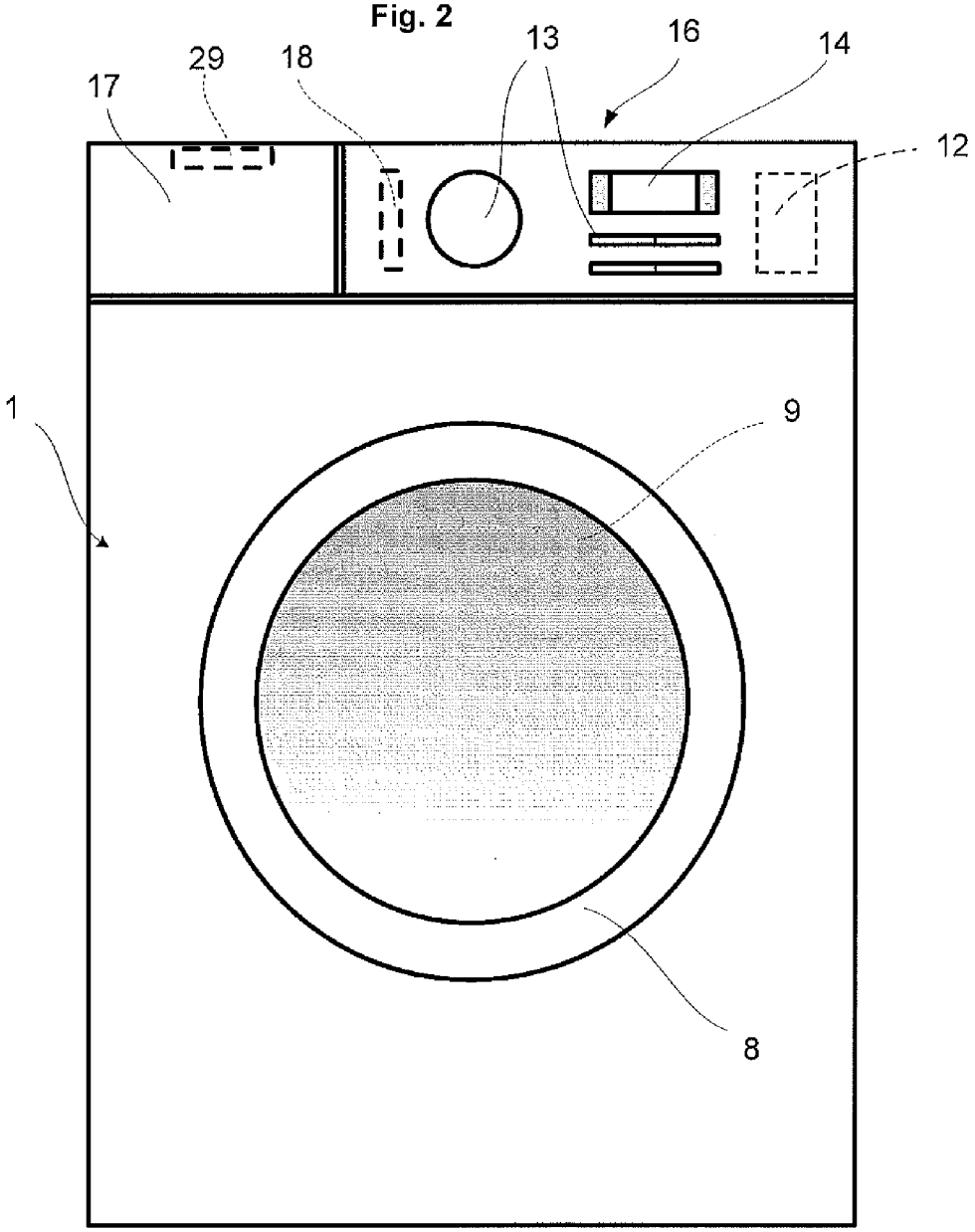
FIG. 2 shows a front view of the washing machine illustrating possible positions of the inventive reader and transmit device and FIG. 3 shows a view from above of a storage compartment drawer with three positions for treatment agents stored in the transporting or supply containers for different applications.

The control device 12 is attached behind the control panel 16 shown in FIG. 2. It can be supplied with parameters (program and additional parameter inputs) by the customer via the input elements 13 (rotary selector and button). The control device 12 calculates a program combination for the treatment process and recommendations for the addition of treatment agents therefrom and from further values relating to the laundry batches and/or fixed specifications measured and sensed in the machine, which the customer has stored in the transporting and supply containers (FIG. 3), located behind the panel 17 in the upper region of the machine housing 1.

A prerequisite for these recommendations is that the storage device (not shown separately) of the control device 12 has contained information relating to the treatment agent, which a reader 18 arranged in close proximity to the transporting or supply containers used in accordance with the invention has read from the information carriers 26 to 28 thereof. Information relating to the stored treatment agent has thus been stored by means of customer actions when the washing machine is switched on. To this end, a reader 18 is arranged proximate to the storage compartment drawer 21 behind the control panel 16 of the washing machine (shown with a dashed line). An information carrier 26 or 27 or 28 of a treatment agent can be read out on this reader 18. Its information contains data relating to the treatment agent stored in the container 22 or 23 or 24; it is now stored in the storage device of the control device and used for the treatment process currently in the preparation stage and also for subsequent treatment processes to be prepared. The data stored in the storage device of the control device is valid until it is replaced by new data for the respective treatment agent.

Figure 3:
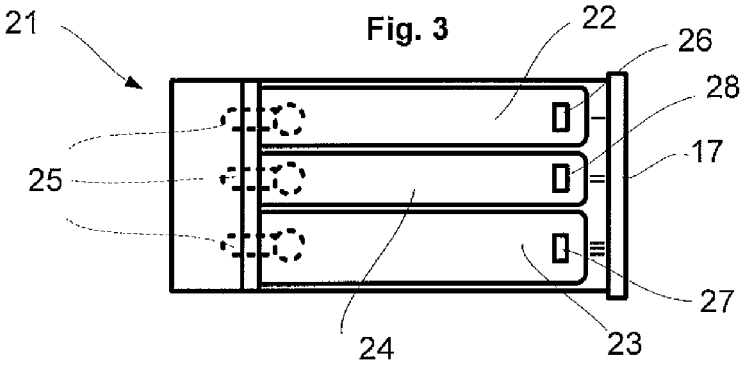

The storage compartment drawer 21 shown from above in FIG. 3 is completely removed from its cavity in the housing 1 of the washing machine and allows the transporting or storage container 22, 23 and 24 for the preparation of individual portions of treatment agent which are inserted from above to be viewed. These treatment agents are composed differently and provided for different types of treatment processes. The transporting or storage containers each contain a metering device 25, which meters the respective treatment agent and transports the same to the tub 2 upon request from the control device.

The reader 18 itself can advantageously contain a transmit device, by means of which empirical information can be transmitted to the information carrier 26 to 28 of the transporting or storage containers 22 to 24. Provided this transmission is to take place, once the transporting or storage containers are correctly inserted into the storage drawer 21, in order to be available for operation of the metering and addition of treatment agent in the treatment process, the transmit device has to emit a correspondingly strong transmit signal. This transmit signal must then also be an identifier for the associated treatment agent, so that the empirical signal is actually only accepted in the assigned information carrier.

Instead of the combination of the reader and transmit device, a separate transmit device 29 (FIG. 2) arranged in proximity to the information carrier 26 to 28 of the correctly inserted transporting or storage container 22 to 24 (FIG. 2) is preferred, the transmit signal of which may have considerably less output. If an individual transmit device is not provided for each information carrier 26 to 28, the transmit signal must however also have an identifier for distinguishing the associated treatment agent. The transporting or storage container 22, 23 and 24 inserted therein support a transponder 26, 27 and 28 on their respective upper sides, which, when the storage compartment drawer 21 is inserted, are proximate to a transmit device 18 arranged above the transporting or storage container.

Alternatively to this separate arrangement of reader and transmit devices 18 and 29, a combined reader and transmit device can however also be attached at the location of the transmit device 29, so that the information carrier 26 to 28 can be queried by the customer at any time from this position and without any special measures using the control device 12 by way of the reader and transmit device, and/or empirical information can be transmitted back thereto.

To insert a transporting or storage container 22 to 24, this is initially guided past the reader 18 behind the control panel 16, so that the information carrier 20 (and/or 26 to 28) can transmit its information relating to the treatment agent to the control device 12 in the washing machine. They are stored there selectively. The transporting or storage container is subsequently installed in the compartment of the storage compartment drawer 21 specific thereto and is at the same time hydraulically coupled to the dispensing system in the washing machine.

Alternatively, the transporting or storage container 22 to 24 is inserted into the storage compartment drawer 21 without any further measures being required and the latter closes. Subsequently, a coupling of the information carrier 26 to 28 to the combined reader and transmit device, which is attached to the point of the transmit device 18, is established automatically. Provided the transporting or storage container is located in the storage drawer 12, information can now be exchanged between the information carrier and the reader and transmit device.

After a metered portion of the treatment agent has been removed from one of the transporting or storage containers 22 to 24 and supplied to the treatment process, this treatment agent can influence certain measurable parameters of the process deviating from an average value to be expected such that an adjustment of the treatment process is necessary in respect of this parameter deviation. As a result, empirical information arises with the use of this treatment information. The treatment process to be run next with the same treatment agent is now likewise to be implemented with the newly obtained empirical value, without the information having to be read out again separately from the information carrier. To this end, the empirical information can be stored in the control device 12 of the washing machine and a treatment agent can be assigned to the already stored information relating hereto. As mentioned above, it is however more reliable to transmit this empirical information back to the information carrier, since the relevant assignment is automatically thereby saved.

A transmit device is provided in the washing machine to transmit the empirical information back, said transmit device may be an integral part of the reader 18, if the transmit signal is strong enough to reach the transponders 26 or 27 or 28 of the transporting or storage container inserted in the storage compartment drawer 21. A more reliable configuration is however provided by one or each transmit device 29 for the transponders 26 to 28 in direct proximity to, namely above the transponder of the inserted transporting or storage container 22 to 24 in the washing machine. The transmit signal then only needs to be small and also does not interfere with any signal receivers located in proximity of the washing machine.

The invention claimed is:

1. A treatment agent metering information evaluator of a washing machine comprising:

a reader configured to read portion-wise metering information from an information carrier of a storage container;

a controller configured to receive the portion-wise metering information from the reader;

a meter configured to meter a treatment agent from the storage container into a drum of a washing machine during a treatment process; and empirical information storage configured to store empirical information about experiences of the use of the treatment agent during the treatment process, wherein said controller is configured to retrieve the empirical information for use in a subsequent treatment process.

2. The evaluator of claim 1, wherein the controller comprises:

modules that identify information-specific variations of a selected or adjusted treatment program being identified; and storage devices which store and retrieve information-specific variations.

3. The evaluator of claim 1, wherein the reader includes a transmitter that transmits the empirical information to the information carrier for storage on the information carrier.

4. The evaluator of claim 1, wherein the storage container contains the treatment agent.

5. The evaluator of claim 1, wherein said controller is configured to retrieve the empirical information for use in a subsequent treatment process which uses the treatment agent, and wherein the controller adjusts the subsequent treatment process based on the empirical information stored in the empirical information storage.

6. The evaluator of claim 1, wherein said controller is configured to retrieve the empirical information for use in a subsequent treatment process which uses the treatment agent, and wherein the controller adjusts the subsequent treatment process based on the empirical information stored in the empirical information storage and the portion-wise metering information.

7. The evaluator of claim 1, wherein said controller is configured to retrieve the empirical information for use in a subsequent treatment process which uses the treatment agent.

8. The evaluator of claim 1, wherein the empirical information relates to respective metering quantities, measured reactions from the treatment process, quantity and type of laundry to be treated, and/or respectively selected or adjusted treatment programs themselves and/or their measurable parameters.

9. The evaluator of claim 3, wherein the transmitter is adjacent to the information carrier of the storage container when the storage container is inserted within the washing machine.

10. The evaluator of claim 3, wherein the information carrier contains a receiver and storage for the empirical information transmitted by the transmitter.

11. A domestic washing machine for washing laundry, the machine comprising:

a drum to hold laundry;

a treatment agent storage container to store a treatment agent, the container having an information carrier that carries information about the treatment agent;

a treatment agent metering information evaluator having:

a reader configured to read the information from the information carrier;

a controller configured to receive the information from the reader;

a meter configured to meter the treatment agent from the container into the drum during a treatment process in accordance with a washing treatment program; and empirical information storage configured to store empirical information about experiences of the use of the treatment agent during the treatment process, wherein said controller is configured to retrieve the empirical information for use in a subsequent treatment process.

12. The domestic washing machine of claim 11, wherein said controller is configured to retrieve the empirical information for use in a subsequent treatment process which uses the treatment agent, and wherein the controller adjusts the subsequent treatment process based on the empirical information stored in the empirical information storage.

13. The domestic washing machine of claim 11, wherein said controller is configured to retrieve the empirical information for use in a subsequent treatment process which uses the treatment agent, and wherein the controller adjusts the subsequent treatment process based on the empirical information stored in the empirical information storage and the information from the information carrier.

14. The domestic washing machine of claim 11, wherein the reader includes a transmitter that transmits the empirical information to the information carrier for storage on the information carrier.

15. The domestic washing machine of claim 11, wherein said controller is configured to retrieve the empirical information for use in a subsequent treatment process which uses the treatment agent.

16. The domestic washing machine of claim 11, wherein the empirical information relates to respective metering quantities, measured reactions from the treatment process, quantity and type of laundry to be treated, and/or respectively selected or adjusted treatment programs themselves and/or their measurable parameters.

17. A domestic washing machine for washing laundry, the machine comprising:

a drum to hold laundry during a treatment process;

a treatment agent storage container to store a treatment agent, the container having an information carrier that carries information about the treatment agent;

a controller; and an empirical information storage configured to store empirical information regarding experiences obtained during the treatment process upon the use of the treatment agent, the empirical information relating to respective metering quantities, measured reactions from the treatment process, quantity and type of laundry to be treated, and/or respectively selected or adjusted treatment programs themselves and/or their measurable parameters, wherein said controller is configured to retrieve the empirical information for use in a subsequent treatment process which uses the treatment agent.

18. The domestic washing machine of claim 17, further comprising a reader configured to read the information from the information carrier, wherein the controller is configured to receive the information from the reader.

19. The domestic washing machine of claim 18, further comprising a meter configured to meter the treatment agent from the container into the drum during the treatment process.

20. The domestic washing machine of claim 17, wherein the controller adjusts the subsequent treatment process based on the empirical information stored in the empirical information storage.

* * * * *